US005239311A

United States Patent [19]

Arimura et al.

[11] Patent Number: 5,239,311

[45] Date of Patent: Aug. 24, 1993

[54] FLAT SLOT ARRAY ANTENNA

[75] Inventors: Kunitaka Arimura; Akira Tsukada, both of Chigasaki; Fumio Takenaga, Kawasaki; Hiroshi Kasuga, Chigasaki, all of Japan

[73] Assignee: Arimura Giken Kabushiki Kaisha, Chigasaki, Japan

[21] Appl. No.: 863,548

[22] Filed: Apr. 6, 1992

Related U.S. Application Data

[63] Continuation of Ser. No. 512,302, Apr. 20, 1990, abandoned.

[30] Foreign Application Priority Data

Apr. 28, 1989 [JP] Japan ..... 1-111170
May 16, 1989 [JP] Japan ..... 1-124069

[51] Int. Cl.[5] ..... H01Q 13/10
[52] U.S. Cl. ..... 343/771; 343/770
[58] Field of Search ..... 343/771, 770, 767, 768, 343/772, 773, 785, 783

[56] References Cited

U.S. PATENT DOCUMENTS

| | | | |
|---|---|---|---|
| 2,447,549 | 8/1948 | Willoughby | 343/771 |
| 2,479,209 | 8/1949 | Chu | 343/771 |
| 2,648,839 | 8/1953 | Ford et al. | 343/771 |
| 2,807,800 | 9/1957 | Broussaud | 343/771 |
| 2,981,949 | 4/1961 | Elliott | 343/770 |
| 3,213,454 | 10/1965 | Ringenbach | 343/771 |
| 3,218,644 | 11/1965 | Berry | 343/770 |
| 3,311,917 | 3/1967 | Thourel | 343/771 |
| 3,500,251 | 3/1970 | Peace | 343/771 |
| 3,530,478 | 9/1970 | Corine et al. | 343/771 |
| 3,568,208 | 3/1971 | Hatcher | 343/771 |
| 3,599,216 | 8/1971 | Paine | 343/771 |
| 3,987,454 | 10/1976 | Epis | 343/771 |
| 3,990,079 | 11/1976 | Epis | 343/771 |
| 4,313,120 | 1/1982 | Westerman | 343/770 |
| 4,518,967 | 5/1985 | Westerman | 343/771 |
| 4,594,595 | 6/1986 | Struckman | 343/770 |
| 4,788,552 | 11/1988 | Karlsson | 343/771 |
| 4,819,003 | 4/1989 | Goto et al. | 343/770 |

*Primary Examiner*—Michael C. Wimer
*Assistant Examiner*—Hoanganh Le
*Attorney, Agent, or Firm*—Schwartz & Weinrieb

[57] ABSTRACT

A flat slot array antenna as composed of a waveguide having a rectangular sectional shape, and a power feeder means connected to the waveguide at a power feed opening. A plurality of wave radiation slots are formed within one of the metallic plates forming the waveguide. The length of each slot is progressively increased toward a terminal end of the power propagation within the space of the waveguide within a range which does not exceed the resonance length of the slot, and the distance between the slots is progressively reduced toward the terminal end of the waveguide.

34 Claims, 25 Drawing Sheets

FLAT SLOT ARRAY ANTENNA

This application is a continuation of application Ser. No. 512,302, filed Apr. 20, 1990, abandoned.

FIELD OF THE INVENTION

The present invention relates to a flat slot array antenna for the communication, broadcasting and other fields, and more particularly to the configuration and arrangement of power radiation slots provided upon a radiating side of the antenna.

BACKGROUND OF THE INVENTION

FIG. 21 shows a conventional slot array antenna which comprises a plurality of slots b equidistantly formed within a plate of rectangular waveguide a. The electromagnetic waves propagate within the rectangular waveguide a in the mode $TE_{10}$. The electrical power radiates from each slot b. FIG. 22 shows the power density distribution within the waveguide.

FIG. 23 shows another conventional antenna having a circular waveguide. The electrical power is fed from a power feeder opening 11 formed within the center of a circular plate 13 and propagates within a space S formed by means of a pair of metallic circular plates 12 and 13 and an annular side plate 14. Slots 12*a*' are arranged in a coaxial array upon the plate 12, each slot 12*a*' having a cross shape configuration of the same dimension. The power radiates from each slot 12*a*'. Residual power remaining within the circular waveguide is absorbed by means of a terminal resistor 16. A circular polarized wave generator is attached to a circular power feeder waveguide 18' as a power feeder means for radiating the power under equiphase conditions.

FIGS. 24 and 25 show another conventional antenna having a different configuration and arrangement of the slots. The electrical power is fed to the circular waveguide through means of a power feeder 18 of a coaxial cable. Within the antenna, as shown in FIG. 25, the direction of a particular slot 12*a* is perpendicular to that of an adjacent slot 12*a* so as to form a pair of slots. Both slots of each pair are disposed at a distance of one fourth ($\lambda g/4$) of the wavelength $\lambda g$ in the radial direction of the plate 12. The resultant electric field of the wave radiated from the pair of slots 12*a* has the configuration of a circularly polarized wave. The pairs of slots 12*a* are spirally disposed upon the plate 12 as is schematically illustrated along a dash-dot line DS so that the wave generated by means of the entire array of slots 12*a* comprises the circularly polarized wave.

FIG. 28 shows still another conventional antenna in which the waveguide space is vertically divided into a lower waveguide space S1 and an upper waveguide space S2 by means of an intermediate horizontally disposed metal plate 15. The terminal resistor 16 is provided at the center of the space S2 or along the axis thereof. The electrical power fed from the power feeder opening 11 propagates within the waveguide space so as to pass through the lower space S1, an annular gap D defined between the side plate 14 and the intermediate plate 15, and the upper space S2. The power of the antenna radiates from the slots 12*a* in an equiphase mode.

However, there are problems in such conventional antennas as follows.

In connection with the antenna shown in FIG. 21, each slot b has the same coupling rate, which represents the rate of power radiating from each slot b, as the others. Consequently, the power density within the waveguide a exponentially decreases as shown in the graph of FIG. 22. As a result, the amplitude distribution within the antenna is irregular so that the side lobe becomes large and the antenna gain is reduced.

In the circular waveguide, the internal electromagnetic field density decreases with the distance r from the power feeder opening 11 as shown by means of the curve Po of FIG. 26. The internal electromagnetic fields couple with the power radiation slots 12*a* so as to be radiated from the slots 12*a* as an electromagnetic wave in free space. A curve P1 of FIG. 26 represents the radiation characteristics thereof. Thus, as shown in FIG. 27, the aperture power distribution is irregular, so that the aperture efficiency is decreased. In addition, the slots disposed adjacent the resonance wavelength affect the power feeder so as to produce a higher order mode.

In connection with the antenna shown in FIG. 28, the power is guided to a central portion within the upper space S2 by means of the side plate 14. Consequently, the power density has a comparatively flat characteristic as shown in FIG. 29, and the power distribution obtained is as shown in FIG. 30. However, the power fed within the waveguide is reflected at the power feeding portion and by means of the side plate 14.

FIG. 31 shows an antenna in which a conical matching member 17 is mounted within the upper end of the power feeder 18 and the side plate 14 is formed such that the inside wall thereof has a V-shaped cross section, thereby preventing the power from reflecting. However, in such an antenna, it is difficult to manufacture the waveguide and manufacturing costs increase.

OBJECT OF THE INVENTION

The object of the present invention is to provide a flat slot array antenna which may increase the slot efficiency by providing a desirable amplitude and phase distribution about the slots with a simple construction.

SUMMARY OF THE INVENTION

According to the present invention, there is provided a flat slot array antenna which includes a waveguide with a space having a rectangular sectional shape and a power feed opening, the waveguide having a plurality of wave radiation slots formed within one of the metallic plates forming the waveguide. The size of each slot and the distance between the slots are progressively changed toward a technical end of the power propagation within the space of the waveguide.

In accordance with a particular aspect of the invention, the length of each slot is progressively increased toward the terminal end within a predetermined range without exceeding a resonance length of the slot, and the distance between the slots is progressively reduced toward the terminal end.

In accordance with another aspect of the invention, the length of each slot is progressively reduced toward the terminal end within a predetermined range without exceeding the resonance length of the slot, and the distance between the slots is progressively increased toward the terminal end.

BRIEF DESCRIPTION OF THE DRAWINGS

These and other objects and features of the present invention will become more apparent from the following detailed description with reference to the accompanying drawings, in which like reference characters designate like or corresponding parts throughout the several views, and wherein.

DETAILED DESCRIPTION OF THE ILLUSTRATED EMBODIMENTS

Figure 1:
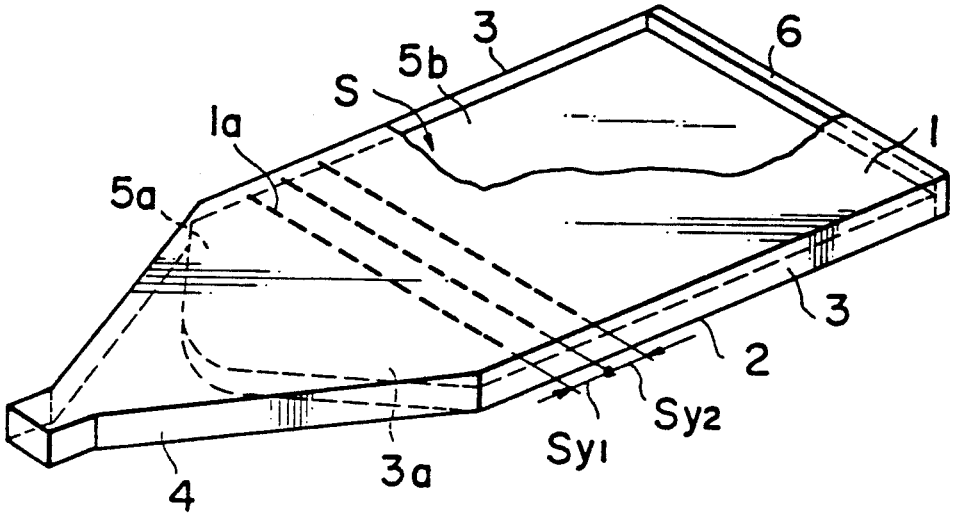
FIG. 1 is a perspective view showing a flat slot array antenna according to a first embodiment of the present invention.

Referring to FIG. 1 showing a first embodiment of the present invention, a slot array antenna according to the present invention comprises a rectangular waveguide having a power feed opening 3*a* formed at an inlet side thereof, and a horn waveguide 4 connected to the rectangular waveguide at the power feed opening 3*a*. The rectangular waveguide comprises opposite rectangular metallic plates 1 and 2, and metal side plates 3 secured to the three sides of each plate 1 and 2 so as to form a rectangular waveguide space S having a rectangular sectional shape. The metallic plate 1 has a plurality of electrical power radiation slots 1*a*, arranged in a matrix. On the inside of the end side plate 3 of the rectangular waveguide, a terminal resistor 6 is provided. The horn waveguide 4 has a lens antenna 5*a* of dielectric material disposed therein.

Electrical power propagates within the horn waveguide 4, with phase fronts being coaxial with respect to an ideal origin. The power is converted to a plane wave when passing through the lens antenna 5*a*. Thus, the power is fed to the rectangular waveguide in the form of a plane wave. Within the space S, a slow-wave device 5*b* such as, for example, a dielectric is provided for suppressing the generation of the grating lobe.

Figure 2:
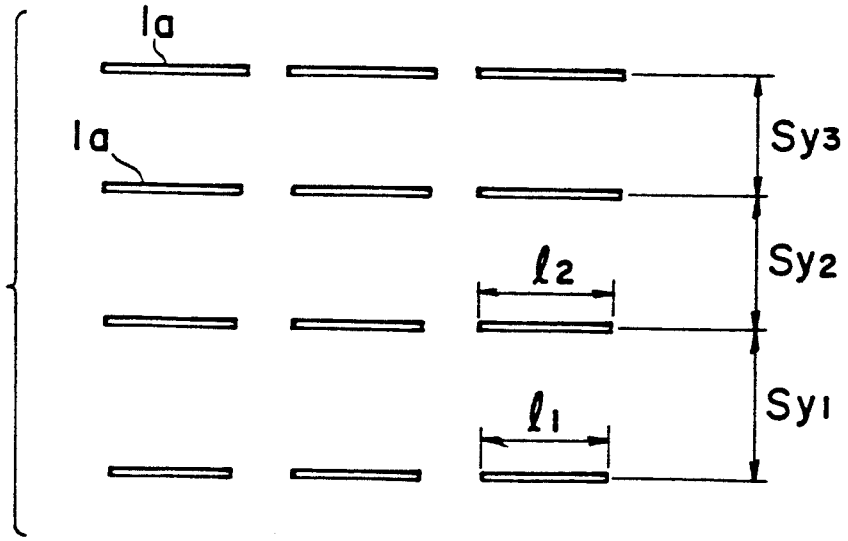
FIG. 2 is a schematic plan view showing the arrangement of the power radiation slots of the antenna of FIG. 1.

Referring to FIG. 2, in order to render uniform the power distribution, the length of each slot 1*a* within each row is made progressively longer toward the terminal end of the antenna. Furthermore, the distances $Sy_1$, $Sy_2$, $Sy_3$ . . . defined between the rows become progressively smaller toward the terminal end.

Figure 3:
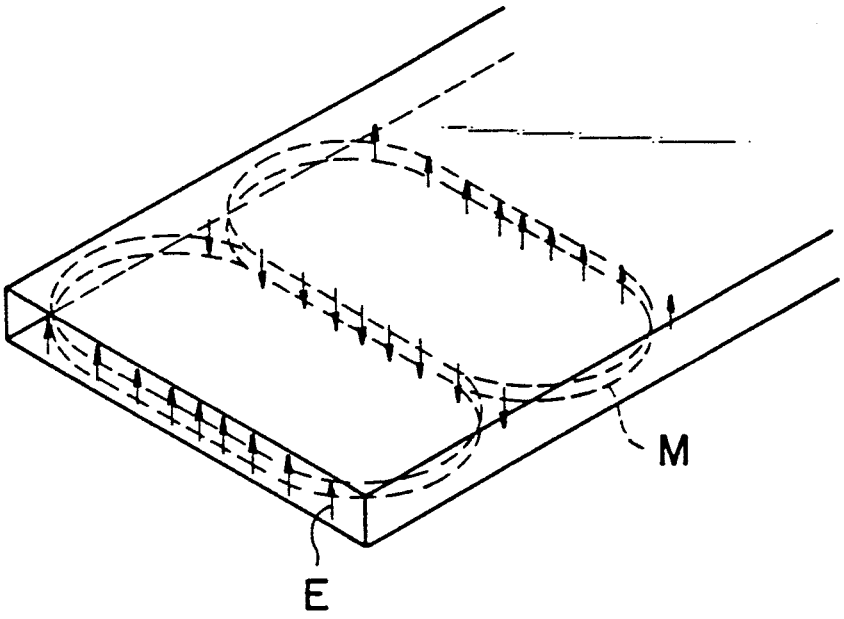
FIG. 3 is a schematic illustration showing the propagation modes of the electrical and magnetic forces.

The electrical power fed from the horn waveguide 4 propagates within the waveguide space in the basic mode as shown in FIG. 3 and radiates from the slots 1*a* in the free space or mode. In the figure, reference E designates the lines of electrical force and M designates the lines of magnetic force. The waveguide shown in FIG. 3 is illustrated regardless of the actual size of the respective parts thereof so as to clearly show the mode. In fact, since the ratio of the width to the height of the waveguide is tens to one, the waveguide is very thin with a large width. Tens of slots can accordingly be provided in the lateral direction in accordance with a particular or predetermined mode.

In order to uniformly radiate the electrical power from all of the slots defined within n rows and in order to radiate all of the electrical power completely without loss, if all of the electrical power is Po, the quantity of power radiated from the slots within each row is Po/n. Therefore, the coupling rate within each row of slots should be determined so that the radiated quantity of power may be Po/n within each row.

If the coupling rate of the slots within a kth row is $\alpha k$ and the internal electrical power after passing through the slots within the kth row is Pk, $$\alpha_1 P_0 = \alpha_2 P_1 = \alpha_3 P_2 = \ldots = \alpha_k P_{k-1} = \ldots = P_0/n$$

Furthermore, $$P_1 = (1 - 1/n)P_0$$
$$P_2 = (1 - 2/n)P_0$$
$$\ldots$$
$$P_k = (1 - k/n)P_0$$

Consequently, $$\alpha_1 = 1/n$$
$$\alpha_2 = P_0/nP_1 = 1/(n-1)$$
$$\ldots$$
$$\alpha_k = 1/(n-k+1)$$

Thus, the coupling rate $\alpha k$ at the kth row is $$1/(n-k+1)$$

Figure 4:
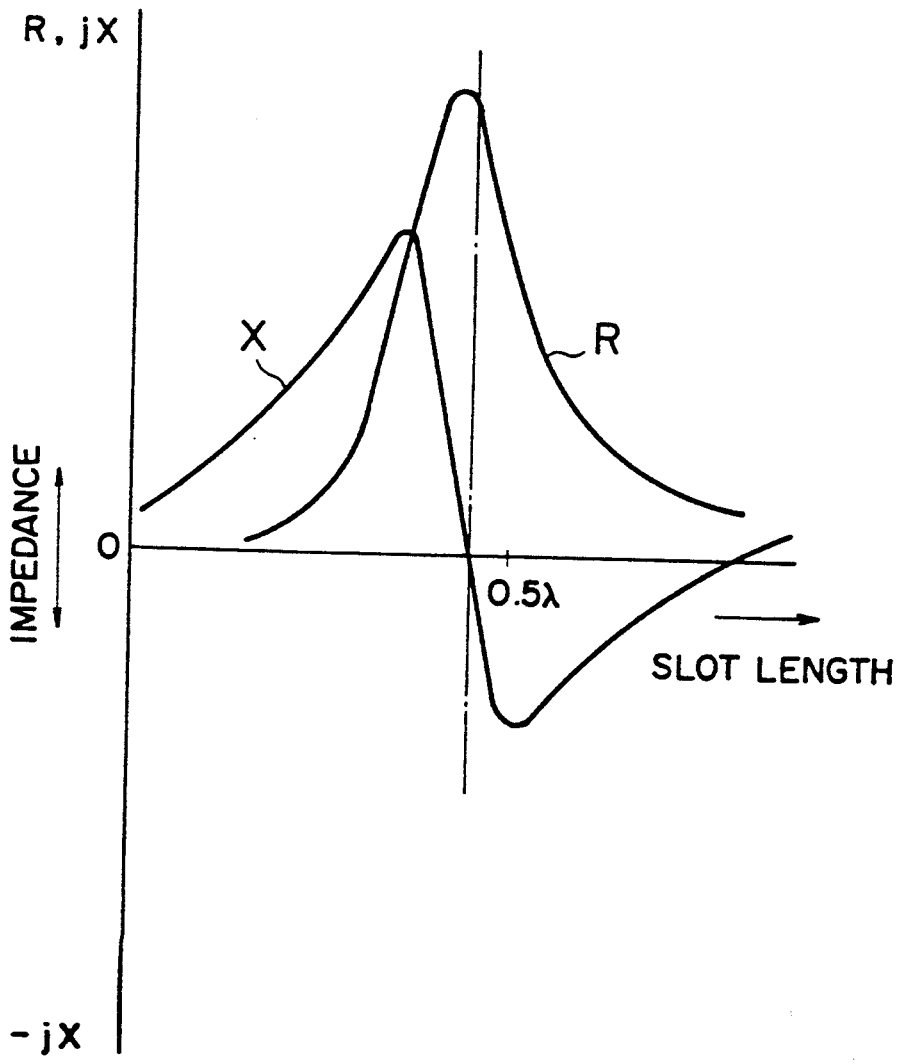
FIG. 4 is a graph showing the relationship between the length of the slots and the impedance of the slots.

FIG. 4 shows the relationship between the length of the slots and the impedance about the one-half wavelength value at a constant frequency. If the length of the slot 1*a* increases, the resistance R and reactance X increase respectively. The reactance X largely decreases within the vicinity of the one-half wavelength so that the impedance achieves a resonance state. The reactance X decreases further as the length of the slot increases. When the reactance X reaches a valley, the reactance X increases again. Meanwhile, the resistance R reduces.

Figure 5:
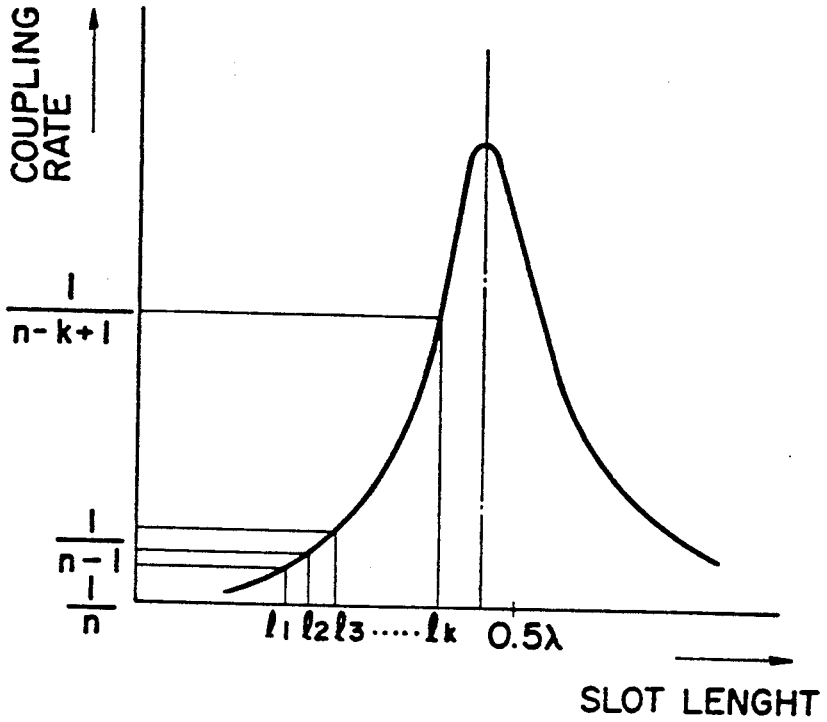
FIG. 5 is a graph showing the relationship between the length of the slots and the coupling rate of the slots.

FIG. 5 shows the relationship between the length of the slot and the coupling rate $\alpha$ dependent upon the impedance. The coupling rate $\alpha$ has a peak value when the length of the slot is within the vicinity of the one-half wavelength. Thus, the length of the slot 1*a* for obtaining a desired coupling rate can be determined from the graph.

The first embodiment uses slots having a length less than one-half wavelength. The slots within every row are formed so as to increase the lengths thereof such as l1 (first row), l2, . . . , lk, . . . , as shown in FIGS. 2 and 5, so that the coupling rates of the slots may be such that the first row becomes $\alpha 1$, the second row is $\alpha 2$ and the kth row is $\alpha k$ so as to uniformly radiate the power. If substantially all of the power is radiated from the slots and the influence of the reflection of the power from the terminal wall within the waveguide can be neglected, the terminal resistor 6 is unnecessary.

Figure 6:
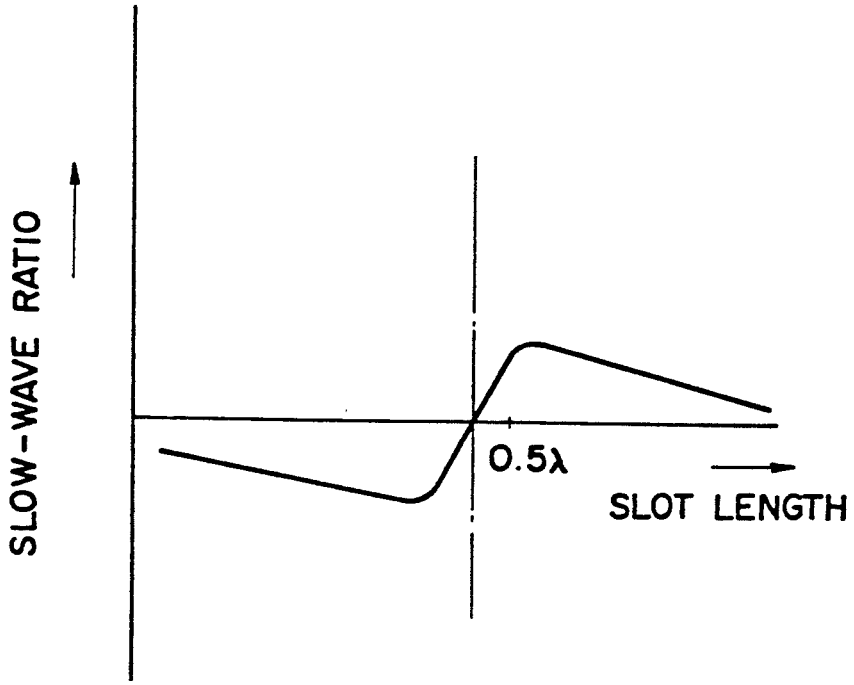
FIG. 6 is a graph showing the relationship between the length of the slots and the slow-wave ratio of the slots.

The phase of the electromagnetic waves radiated from the slots advances or retards with respect to the phase within the waveguide space in accordance with the reactance X shown in FIG. 4. FIG. 6 illustrates the slow-wave ratio $\zeta$ of the wavelength $\lambda g$ within the waveguide space to the wavelength $\lambda$ within free space, taking into consideration the retarding phase and the advancing phase, as a function of slot length. The slow-wave ratio $\zeta$ decreases when the length of the slot 1*a* is less than one-half wavelength. The ratio $\zeta$ largely increases when the slot length is within the vicinity of one-half wavelength and again decreases as the length of the slot further increases. If the distance between the rows of the slots is adjusted in accordance with the slow-wave ratio $\zeta$, the equiphase electromagnetic waves are radiated from the slots within each row. In accordance with the illustrated embodiment, the distance between the rows is progressively reduced toward the terminal end of the waveguide.

For example, if the width of the waveguide is 30 cm and the length is 50 cm, the efficiency is 70% and the gain is approximately 33.2 dBi at 12 Ghz.

If slots having a longer length than one-half wavelength are used, the length of the slots is progressively reduced and the distance between the rows is gradually increased toward the terminal end of the waveguide.

Furthermore, if the distance between the rows is increased at a predetermined rate, the directivity of the waves inclines toward the terminal end of the waveguide. If the distance defined between the rows is reduced, the directivity of the waves inclines in the opposite direction. Thus, the directivity can be easily and desirably inclined and controlled.

Figure 7:
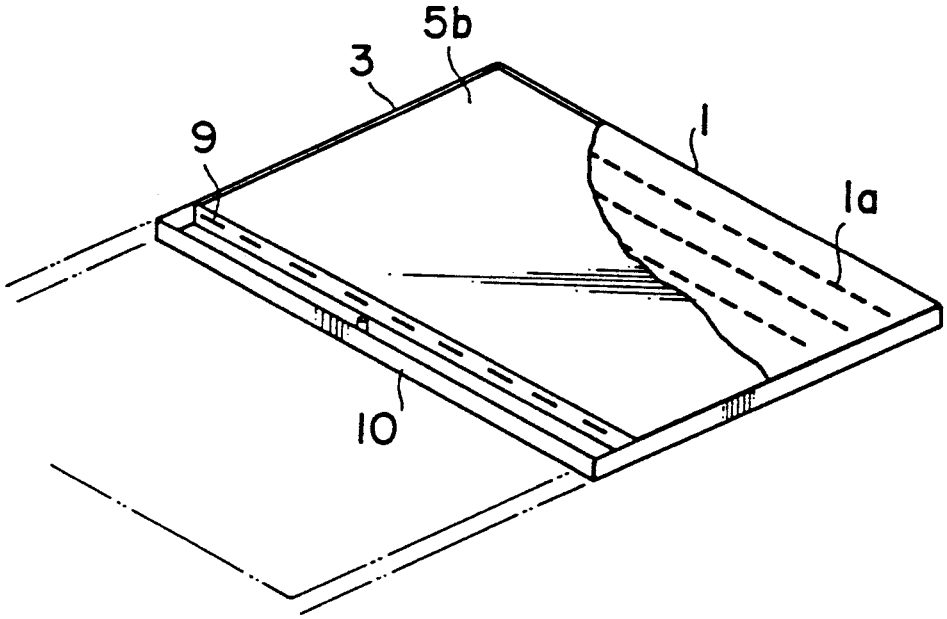
FIG. 7 is a perspective view of a second embodiment of the present invention which comprises a first modification of the antenna of FIG. 1.
Figure 8:
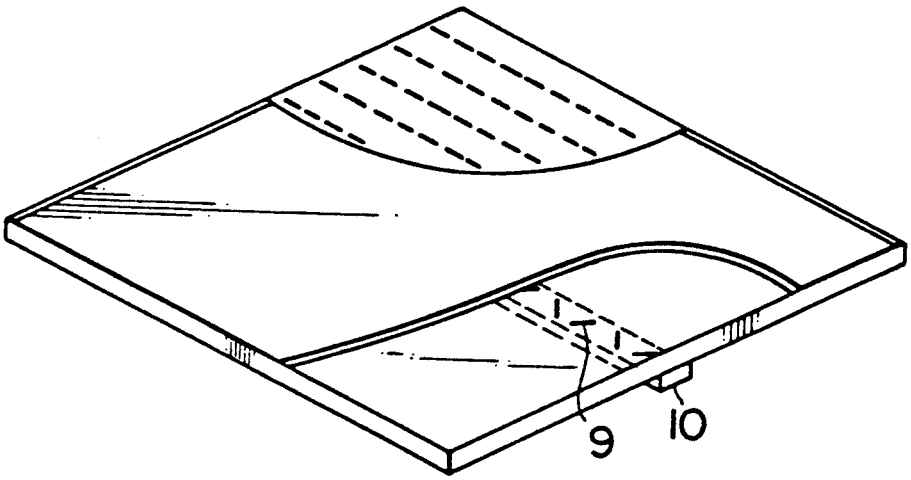
FIG. 8 is a perspective view of a third embodiment of the present invention which comprises a second modification of the antenna of FIG. 1.

Referring to FIGS. 7 and 8 showing first and second modifications of the first embodiment of the present invention, and therefore comprising second and third embodiments of the invention, a rectangular feeder waveguide 10 having feeder openings 9 defined within a metallic plate thereof is attached to the rectangular waveguide as the power feeder means. Other structural components are the same as those of the first embodiment. Thus, the uniformity of the internal power is increased and the distribution efficiency is improved. In addition, the antenna is compact in size.

In accordance with the first modification, or second embodiment of the present invention, the antenna may be symmetrically formed about the power feeder 10 as shown by means of the dash-dot lines of FIG. 7, as is similarly formed in accordance with the second modification or third embodiment of FIG. 8. In such a construction, even if the frequency changes so as to change the directivity, the resultant directivities of the waves within both sides are constant. Thus, a stable characteristic can be obtained within a wide range.

As the power feeder means, a microstrip line may be employed for energizing a plurality of posts or slots.

Within the antenna of the illustrated embodiment, although power is radiated within an H-plane, an E-plane type radiation pattern may likewise be used for radiating the power.

Figure 9:
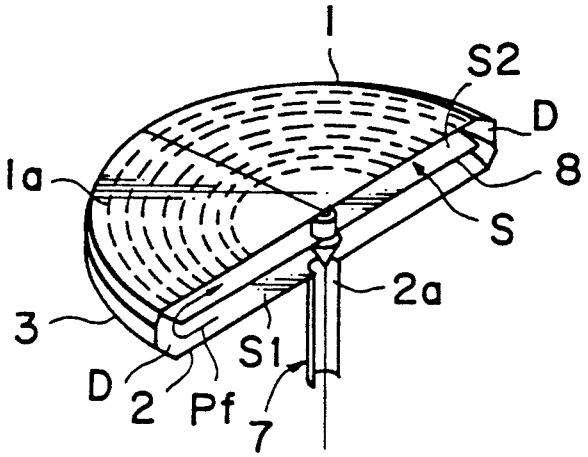
FIG. 9 is a perspective view showing a fourth embodiment of the present invention, a part of which is in section.

Referring to FIG. 9 showing the fourth embodiment of the present invention, a circular slot array antenna comprises a metallic circular radiation plate 1 having a plurality of slots la disposed therein in a coaxial or spiral array, a metallic circular plate 2 provided opposite to the plate 1, and a metallic annular side plate 3 secured between the outer peripheral portions of the circular plates 1 and 2 so as to form a waveguide space S. A power feeder 7 comprising a coaxial cable is mounted within a power feeder opening 2*a* formed within the center of the plate 2 along the axis thereof.

An intermediate, horizontally disposed metal plate 8 is provided within the waveguide space S, with a space defined between the peripheral edge portion of plate 8 and the side plate 3 for transmitting the power throughout the waveguide space S. The waveguide space S is thus vertically divided into a lower waveguide space S1 and an upper waveguide space S2.

The length of the slots is progressively reduced as one proceeds toward the center of the waveguide in order to obtain a uniform aperture power distribution.

The power Pf fed from the power feeder opening 2*a* propagates within the space S by passing through the lower space S1, an annular gap D defined between the side plate 3 and the intermediate plate 8 and the upper space S2. Equiphase power therefore radiates from the slots 1*a*.

Figure 10:
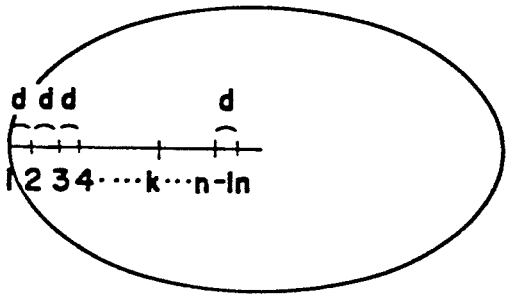
FIG. 10 is a schematic perspective view showing an arrangement within the slots of the fourth embodiment.
Figure 11:
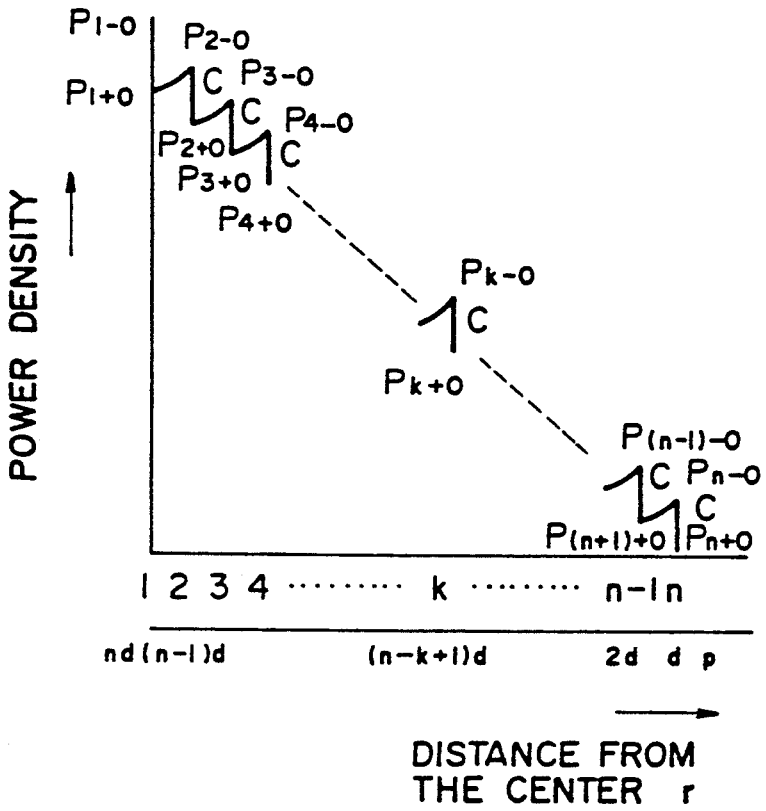
FIG. 11 is a graph showing the power density distribution within the waveguide space of the antenna of FIG. 10.

Describing the slot array arrangement of the fourth embodiment with reference to FIGS. 10 and 11, n circles of slots are disposed at regular radial intervals d. Therefore, the radius of the outermost circle is represented as nd. If the power density before radiating from the slots within the kth slot circle as enumerated with respect to the outermost or first circle is $Q_{k-0}$, the power density after the radiation from the slots within the kth circle is $Q_{k+0}$, the initial power density is Qo, and the power radiated from each slot is C, the power density before passing the slots defined within the first circle is represented as $$Q_{1-0}=Q_o$$

The power density after passing the first slot circle is $$Q_{1+0}=Q_o-c$$

The power density before passing the second slot circle is $$Q_{2-0} = Q_{1+0} \times \frac{nd}{(n-1)d} = (Q_0 - C)\frac{nd}{(n-1)d}$$

The power density after passing the second slot circle is $$Q_{2+0} = Q_{2-0} - C = (Q_0 - C)\frac{nd}{(n-1)d} - C$$

If the power density becomes zero after passing the slots defined within the nth circle, the following equation is obtained:

$$\left(\left(\cdots\left[\left\{(Q_0 - C)\frac{nd}{(n-1)d} - C\right\}\frac{(n-1)d}{(n-2)d} - C\right]\cdots\right)\frac{3d}{2d} - C\right)\frac{2d}{d} - C = 0$$

$$nQ_0 - \{n + (n-1) + (n-2) + \ldots + 3 + 2 + 1\}\,C = 0$$

$$C = \frac{2Q_0}{n+1}$$

Thus, the power radiated from each slot is $$\frac{2\,Q_0}{n+1}$$

If the coupling rate αk of the kth slot circle is determined so that the product of the coupling rate αk multiplied by means of the power density $Q_{k-0}$ fed to the kth slot circle may be the radiated power C, the aperture amplitude distribution of the plate 1 becomes uniform.

Since the power density $Q_{k-0}$ is $$Q_{k-0} = \left(\cdots\left[\left\{(Q_0 - C)\frac{nd}{(n-1)d} - C\right\}\frac{(n-1)d}{(n-2)d} - C\right]\cdots\right)\frac{\{n-(k-2)\}d}{\{n-(k-1)\}d}$$

$$= \frac{n}{n-(k-1)}Q_0 - \left(\frac{n}{n-(k-1)} + \frac{n-1}{n-(k-1)} + \ldots + \frac{n-(k-2)}{n-(k-1)}\right)C$$

$$= \frac{1}{n-(k-1)}\left(nQ_0 - \frac{(k-1)(2n-k+2)}{2}C\right)$$

the coupling rate is $$\alpha_k = \frac{C}{Q_{k-0}} = \frac{(n-k+1)C}{nQ_0 - \frac{(k-1)(2n-k+2)}{2}C}$$

Thus, the length of each slot 1*a* is determined as a result of being based upon the coupling rate αk, and the distance defined between the slot circles is accordingly adjusted so that the electromagnetic waves having equiphase characteristics and the same amplitude radiate from the slots.

Any deviation of the phases of the waves caused by means of the inequality of the lengths of the slots is corrected by adjusting the distance defined between the slot circles. Since a desired coupling rate can be provided, a desired aperture distribution such as, for example, a binomial distribution, Taylor distribution, and Dolph-Chebyshev distribution can be obtained, whereby an antenna having high performance characteristics can be provided.

In the case where the slots la are spirally disposed upon the circular plate 1, the internal electromagnetic power P per unit area upon a circle at a radius r is expressed as $$P=Po/\,(2\,\pi r\times h)$$

where Po is the entire power fed to the waveguide and h is the distance within the waveguide space.

The radiated electrical power Pr at the position of the radius r is $$Pr=\alpha\times P=\times Po/\,(2\pi r\times h)$$

Therefore, the radiated power Prn from the slots of the nth circle is $$Prn=\alpha n\times Pn$$

and $$Pn=(1-\alpha_{n-1})\times P_{n-1}\times r_{n-1}/r_n$$

$r_n$: the distance between the slots of the nth slot circle and the center of the waveguide)

Although each slot 1a has a shorter length than the one-half wavelength, a slot having a longer length can be used in accordance with the fourth embodiment.

Figure 12:
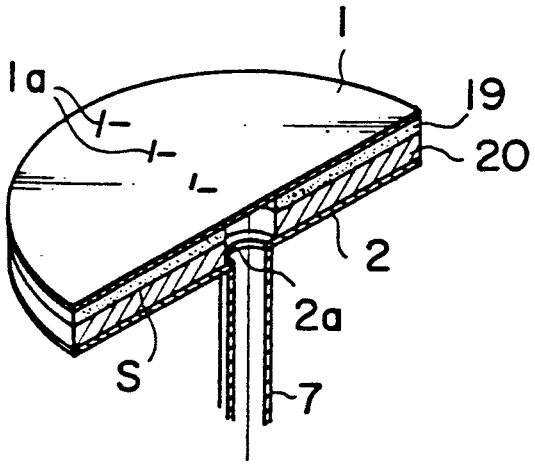
FIG. 12 is a perspective view showing a fifth embodiment of the present invention, a part of which is in section.

Referring now to FIG. 12 showing the fifth embodiment of the present invention, the circular slot antenna of the third embodiment has a slow-wave means disposed within the waveguide space S. More particularly, the slow-wave means comprises a first layer 19 made of polystyrene foam and a second layer 20 made of polyethylene disposed beneath the first layer 19.

As the slow-wave means, foamed plastics such as, for example, polyethylene foam and polypropylene foam, and a corrugated circuit may be used. If the slots 1a are formed within one wavelength distances, the slow-wave means is not provided, but a suitable insulation is provided between the plates 1 and 2 so as to maintain the space therebetween.

Figure 13:
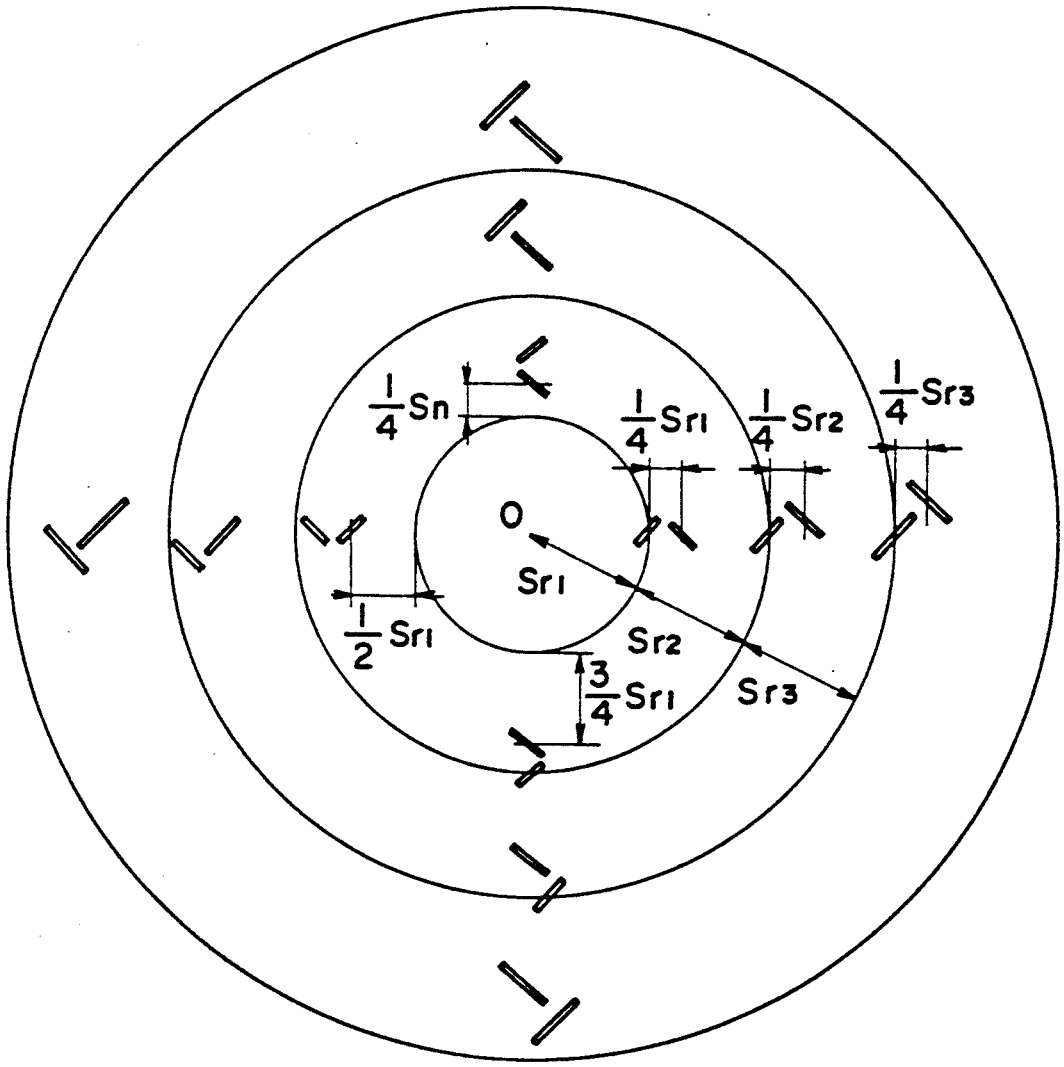
FIG. 13 is a schematic plan view of the fifth embodiment of the antenna of the present invention.

Referring now to FIG. 13, in order to obtain a desired aperture power distribution, the dimension (width or length) of each slot 1a is progressively increased toward the outer periphery of the waveguide. The distance defined between the slots disposed upon a particular radius is progressively educed toward the periphery ($Sr_1 > Sr_2 > Sr_3 > \ldots$).

Figure 14:
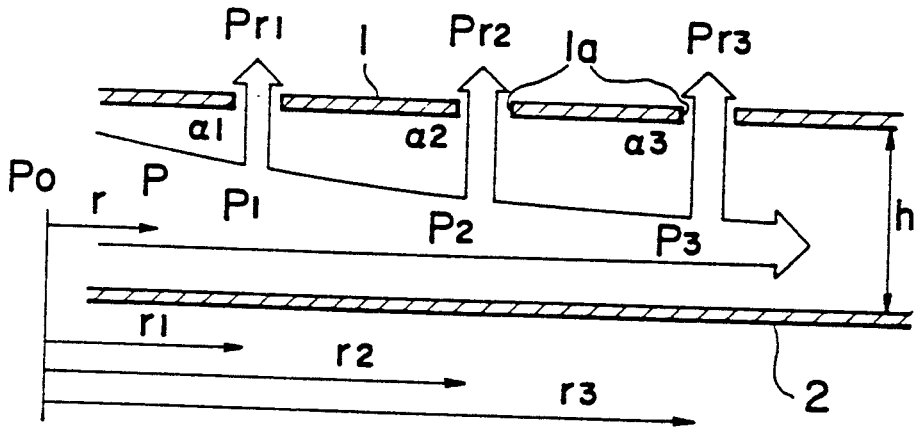
FIG. 14 is a schematic illustration showing the flow of the electrical power within the waveguide space.

FIG. 14 shows the electromagnetic power internally within the waveguide. If the radius r of a circle passing a slot is $r > \lambda g$, the internal power P per unit area is reduced with a corresponding increase of the radius r. The internal electromagnetic power P per unit area upon a circle at the radius r is expressed as $$P = Po/(2\pi r \times h)$$

where Po is the total power fed to the waveguide and h is the distance within the waveguide space.

The radiated electrical power Pr at the position of the radius r is $$Pr = \alpha \times P = \alpha \times Po/(2\pi r \times h)$$

The coupling rate $\alpha$ is determined in accordance with the lengths of the slots corresponding to the wavelength $\lambda$ within the free space, the dielectric constant $\epsilon r$ of the resin used for the slow-wave means and the distance h within the waveguide space.

Therefore, the radiated power Prn from the slots of the nth circle from the center is $$Prn = \alpha n \times Pn$$

and $$Pn = (1 - \alpha_{n-1}) \times P_{n-1} \times r_{n-1}/r_n$$

Figure 16A:
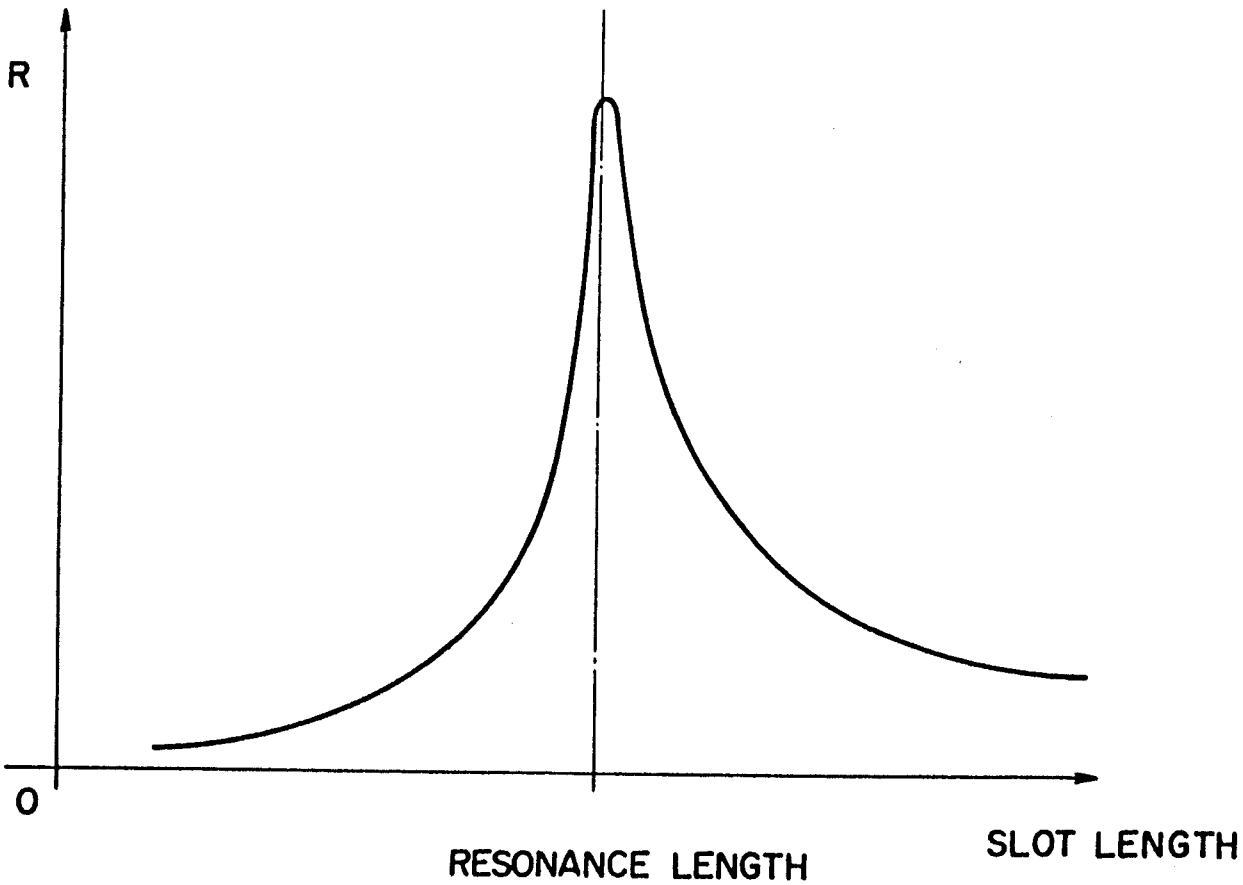
FIGS. 16*a* and 16*b* are graphs showing the impedance characteristics of the slots of the fifth embodiment of the present invention.
Figure 16B:
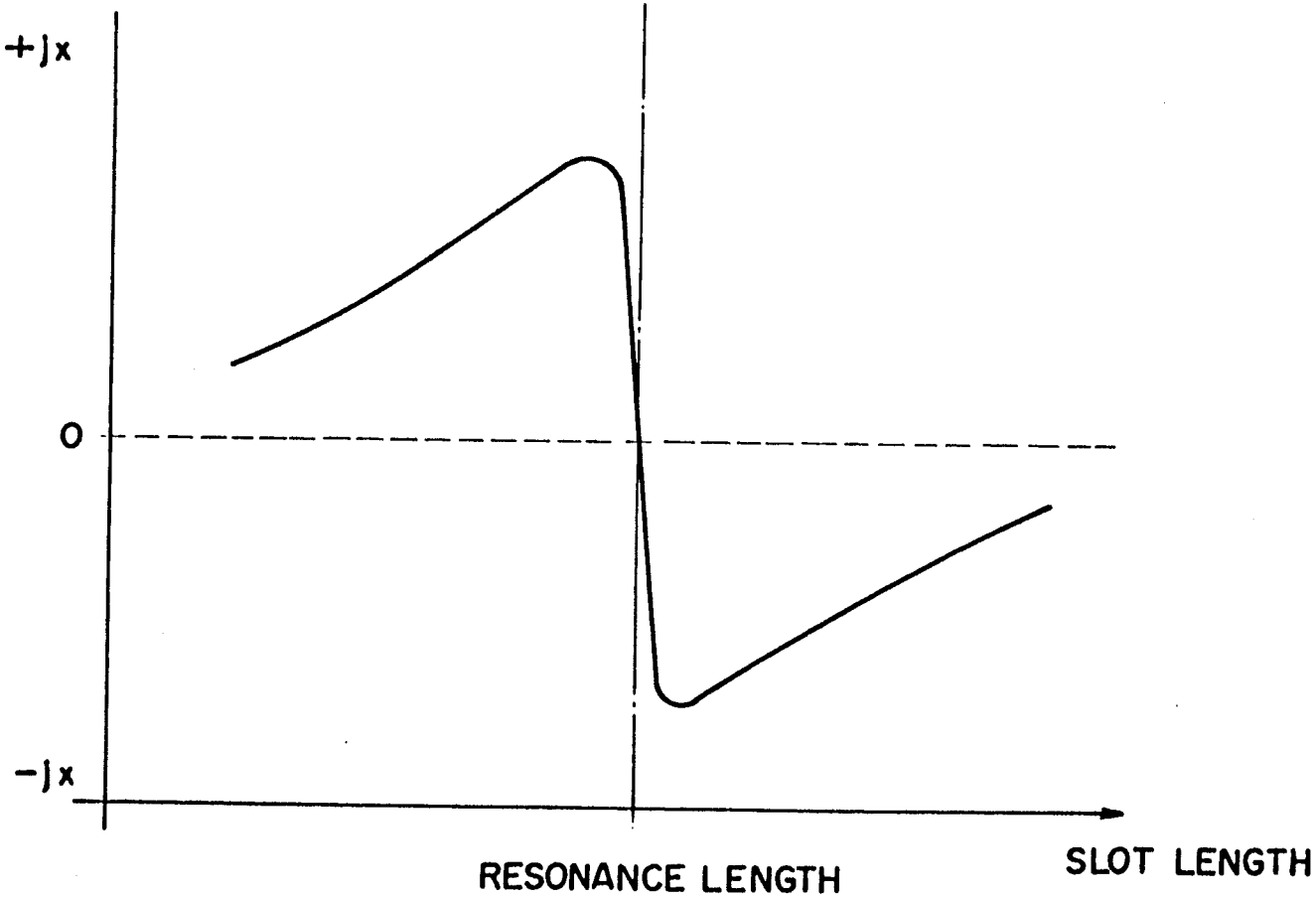
Figure 17A:
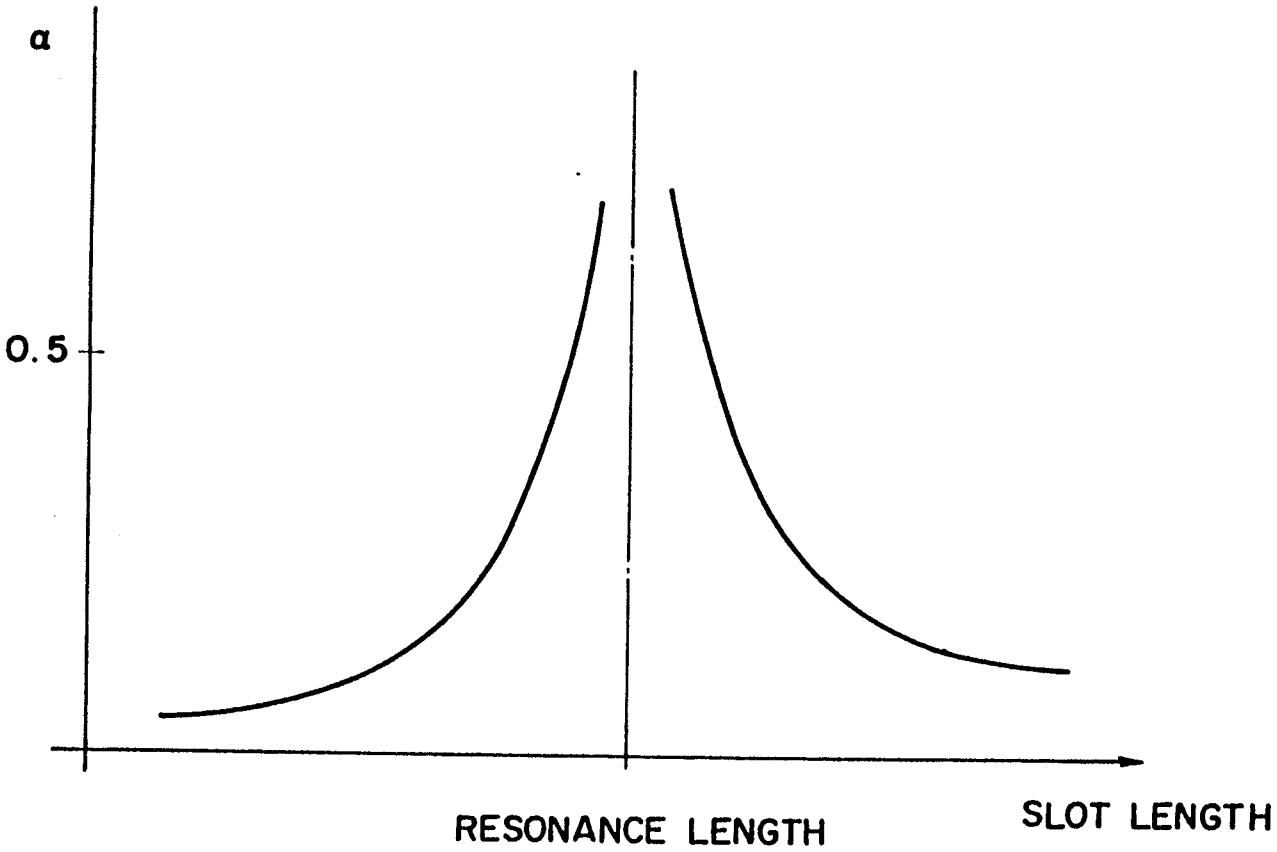
FIG. 17*a* is a graph showing the relationship between the length of the slots and the coupling rate of the slots of the fifth embodiment of the present invention.

FIGS. 16a and 16b show the relationship between the lengths of the slots an the impedance within the vicinity of one-half wavelength at a predetermined frequency. If the other parameters are constant, the relationship between the length of each slot and the coupling rate $\alpha$ has a characteristic similar to the real part of the impedance as shown in FIG. 17a.

Figure 15:
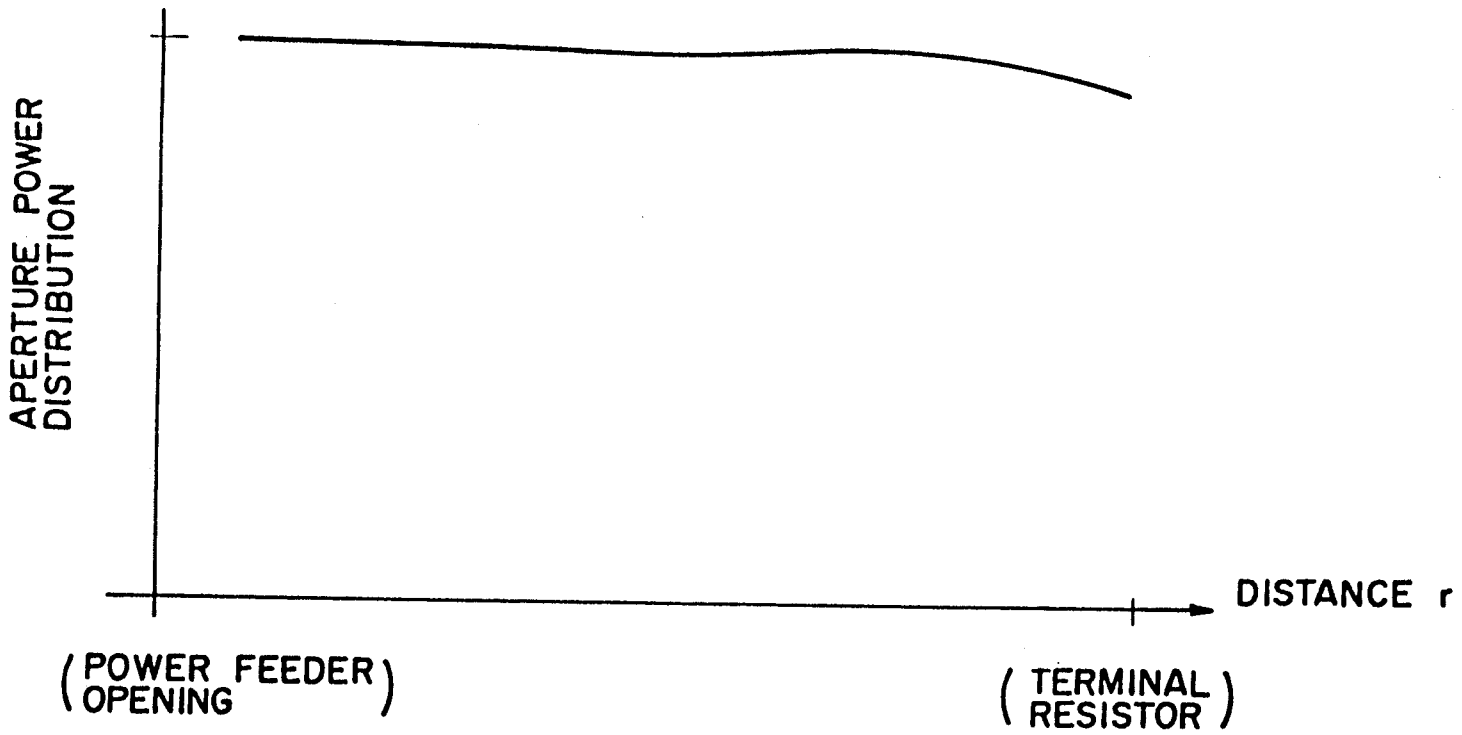
FIG. 15 is a graph showing the aperture power distribution.

It will be seen from the graphs that the coupling rate $\alpha$ decreases as the length of the slot deviates from the resonance length (that is, within the vicinity of one-half wavelength). Since the length SL of each slot within every circle is gradually increased toward the periphery ($SL_1 < SL_2 < \ldots$) so that the coupling rate $\alpha$ may increase ($\alpha_1 < \alpha_2 < \alpha_3 < \ldots$) and the aperture power distribution may be $Pr_1 = Pr_2 = \ldots$, the aperture power distribution is rendered as shown in FIG. 15. For example, if the diameter is approximately $20\lambda o$ and the width of a particular slot is $0.04\lambda o$, the length SL is $$0.3\,\lambda o \leqq SL \leqq \text{resonance length} \approx 0.46\lambda o$$

Figure 17B:
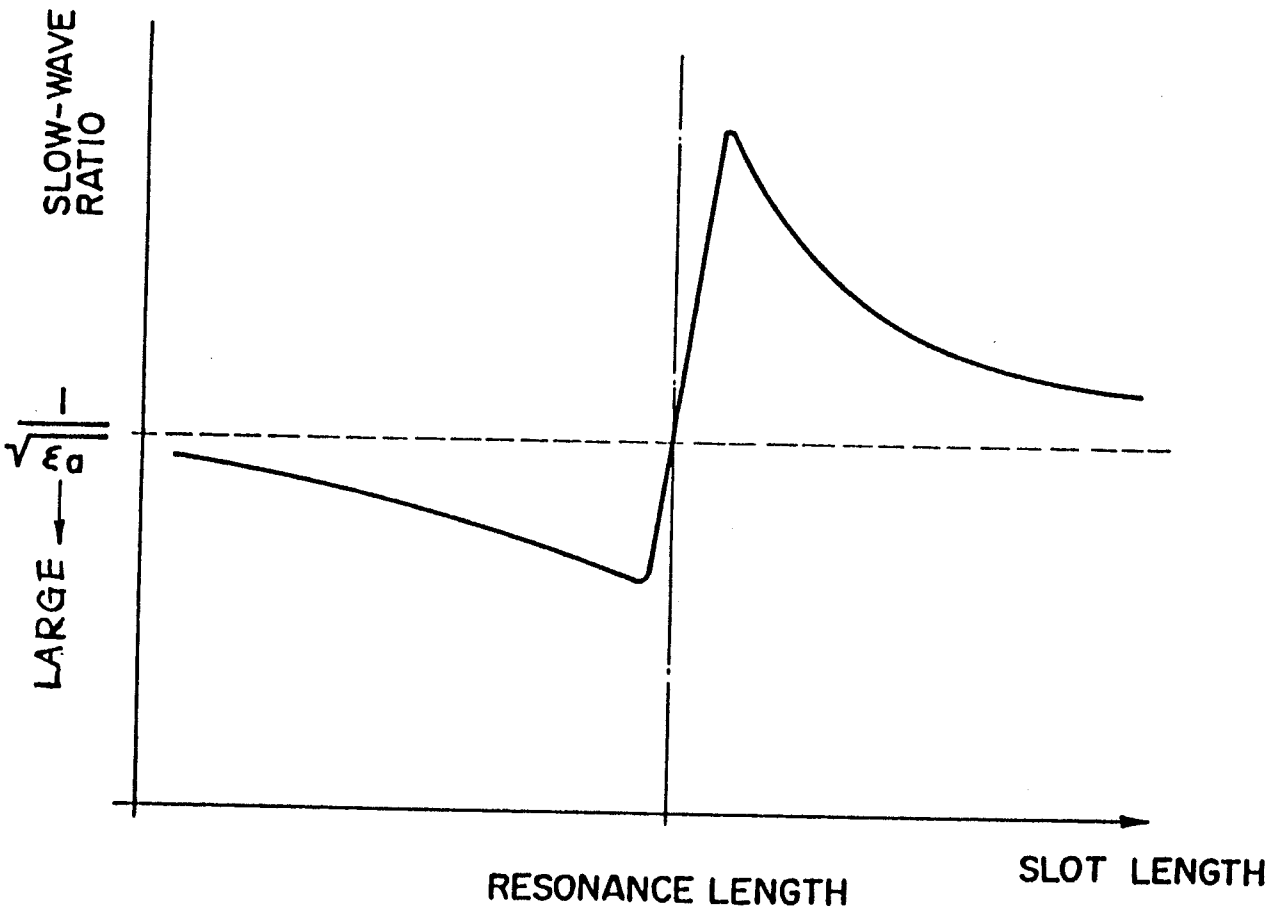
FIG. 17*b* is a graph showing the slow-wave ratio.

Since the impedance shown in FIG. 16b has an imaginary component, the phases of the power Pn and the radiated power Prn are advanced or retarded within the vicinity of the resonance length. Accordingly, the slow-wave ratio changes irregularly as shown in FIG. 17b.

In order to correct the differences in phases, the distance between the circles of the slots is reduced ($Sr_1 > Sr_2 > Sr_3 > \ldots$) as one proceeds radially outwardly so as to provide equiphase waves. Thus, the resultant electromagnetic field of equiphase waves is formed, thereby providing an antenna having a high degree of efficiency. In accordance with this embodiment, the same effect as with the previous embodiments is achieved.

Figure 18:
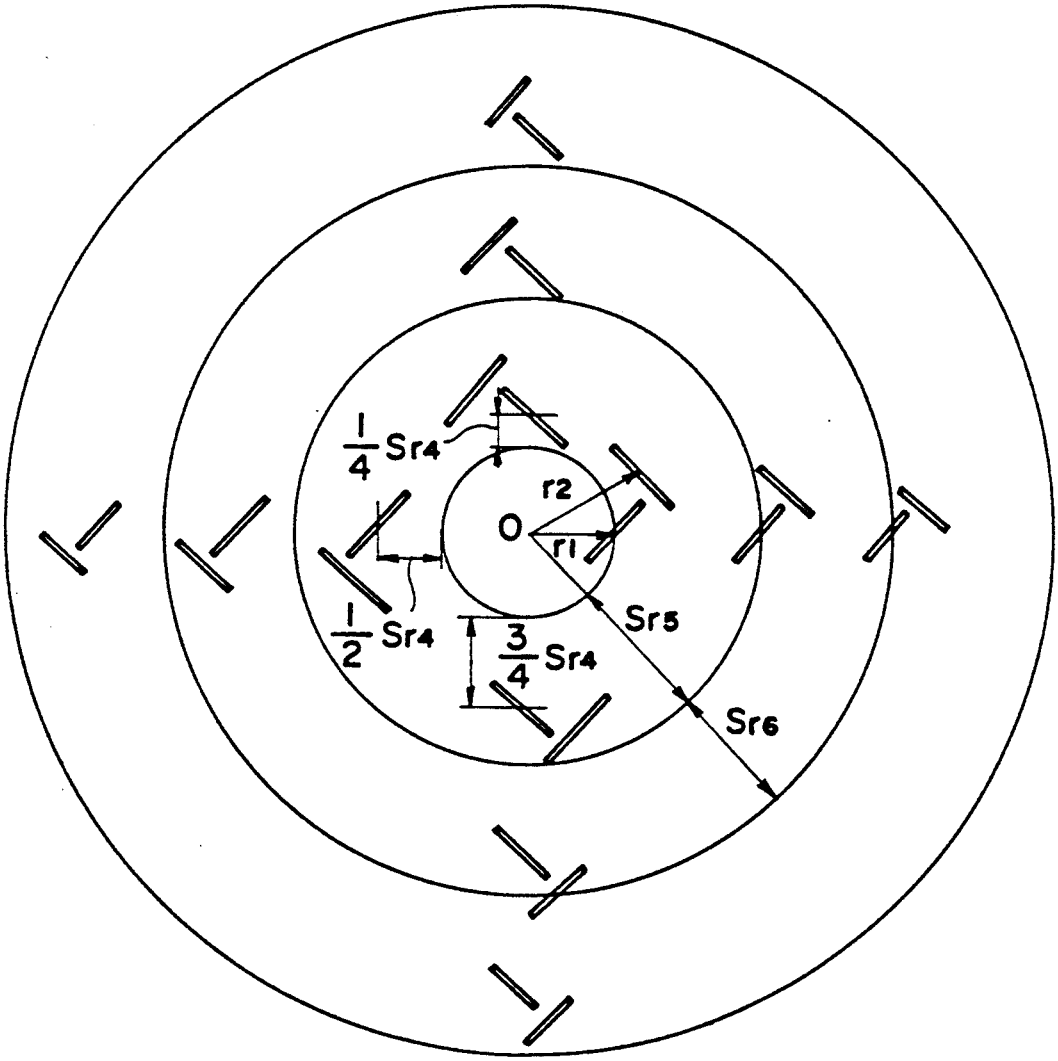
FIG. 18 is a schematic plan view showing a sixth embodiment of the present invention which comprises a modification of the fifth embodiment of the present invention as illustrated in FIG. 12.

FIG. 18 shows a modification of the fifth embodiment so as to define a sixth embodiment in which the length of each slot is larger than the resonance length. In accordance with this modification, the length of each slot within every circle is reduced as one proceeds toward the periphery of the antenna. However, the slots are disposed so as to increase the coupling rate $\alpha$ as one proceeds toward the outer periphery of the waveguide. The slots of the outermost circle have the same lengths as those of the fifth embodiment, that is, they have a length equal to that of the resonance length at the operating frequency within the space S.

The phases of the electric power propagated in the space S and the radiated power Pr change in such a way that $Sr_4 < Sr_5 < Sr_6 < \ldots$ which is the inverse of the antenna of the fifth embodiment. Thus, the slots are disposed correspondingly. The same effect as achieved in accordance with the fifth embodiment can be similarly obtained with the present embodiment of the present invention.

Figure 19:
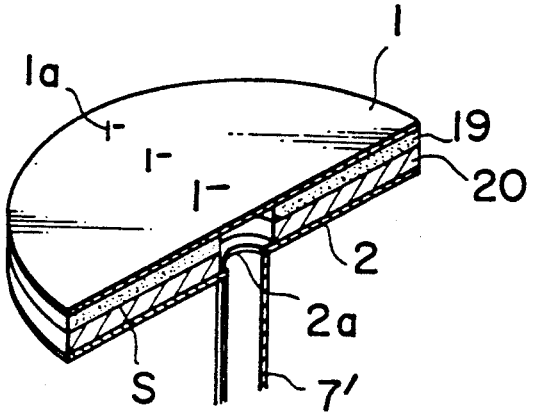
FIG. 19 is a sectional perspective view showing a seventh embodiment of the present invention.

FIG. 19 shows the seventh embodiment of the present invention wherein a cylindrical power feeder waveguide 7' is mounted adjacent the power feeder opening 2a in place of the power feeder 7. Other structural components are the same as those of the fifth embodiment discussed above.

The power in the mode of $TE_{01}$ or $TM_{01}$ is fed to the feeder waveguide 7'. The embodiment may use the two types of slot arrangements described in connection with the fifth embodiment.

Figure 23:
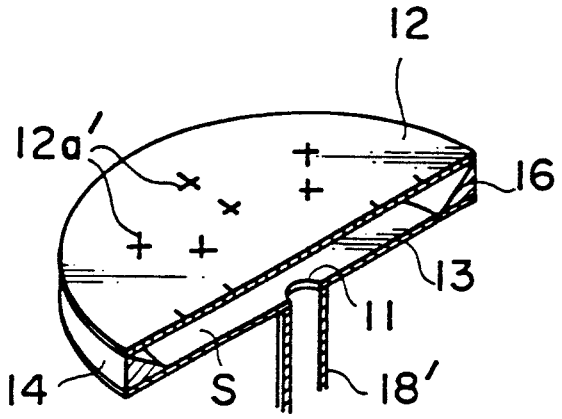
FIG. 23 PRIOR ART
FIG. 23 is a sectional perspective view showing a second conventional antenna of FIG. 21.
Figure 24:
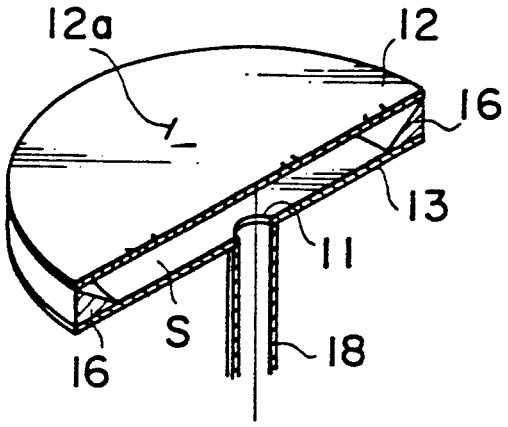
FIG. 24 PRIOR ART
FIG. 24 is a sectional perspective view showing a third conventional antenna.
Figure 25:
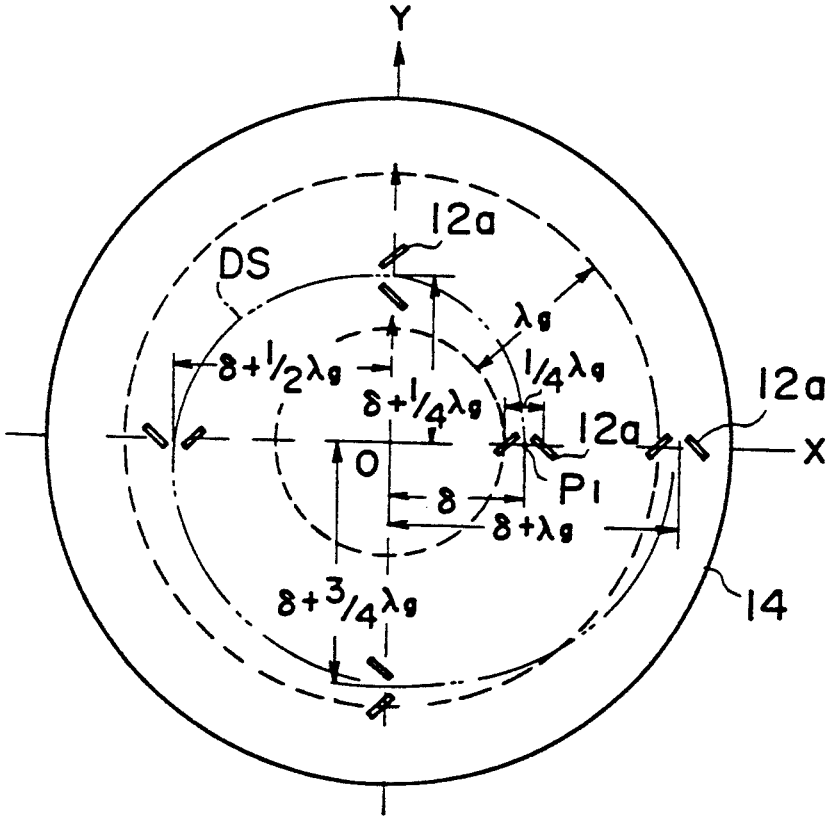
FIG. 25 PRIOR ART
FIG. 25 is a schematic plan view of the third conventional antenna of FIG. 24.
Figure 26:
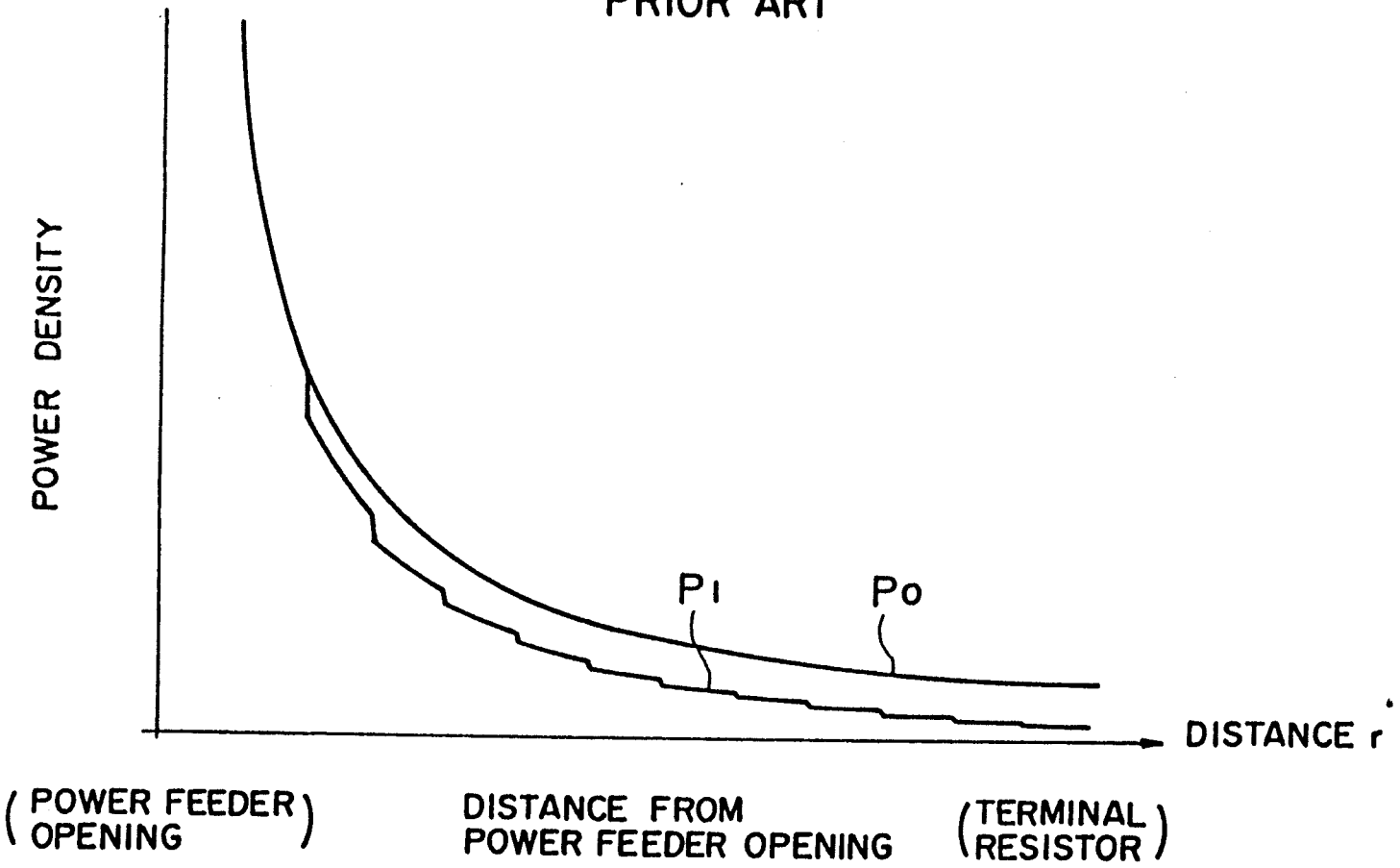
FIG. 26 PRIOR ART
FIG. 26 is a graph showing the power density distribution of the third conventional antenna of FIG. 24.
Figure 27:
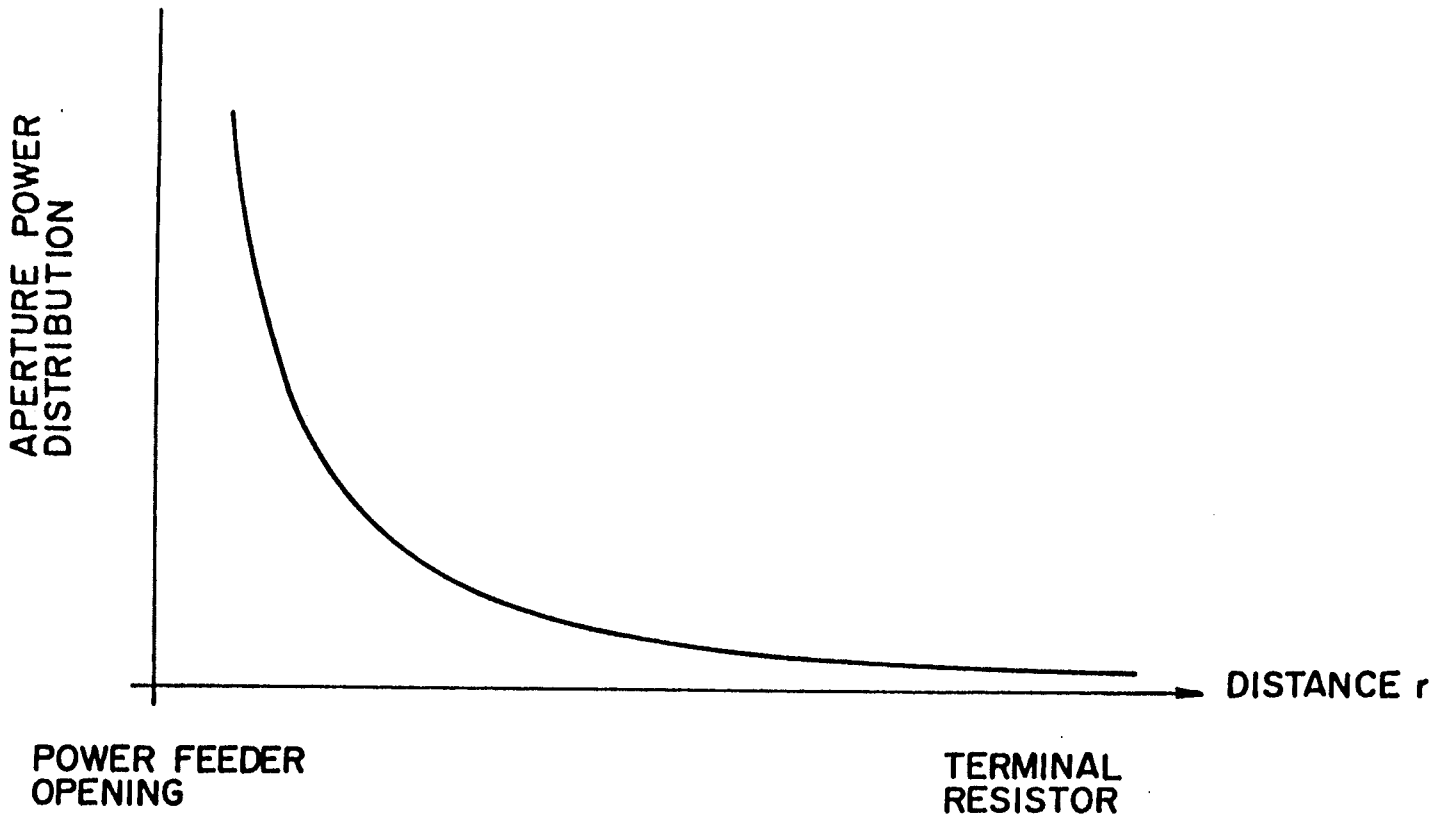
FIG. 27 PRIOR ART
FIG. 27 is the graph showing a power distribution of the antenna of FIG. 24.
Figure 28:
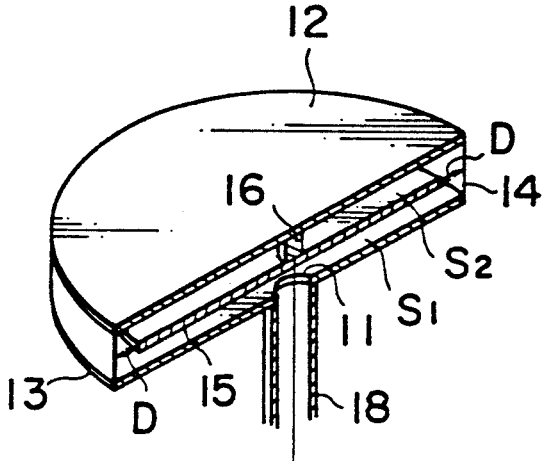
FIG. 28 PRIOR ART
FIG. 28 is a sectional perspective view showing a fourth conventional antenna.
Figure 31:
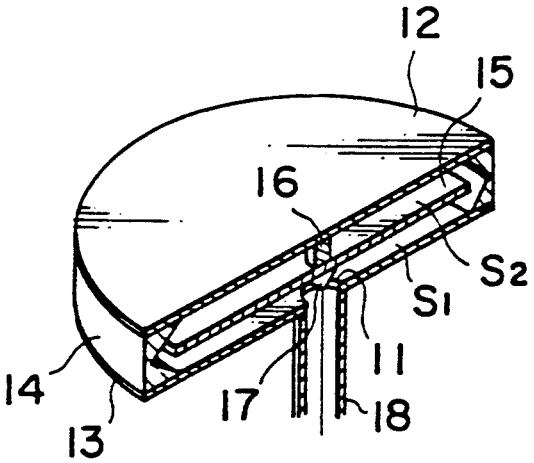
FIG. 31 PRIOR ART
FIG. 31 is a sectional perspective view showing a fifth conventional antenna.
Figure 29:
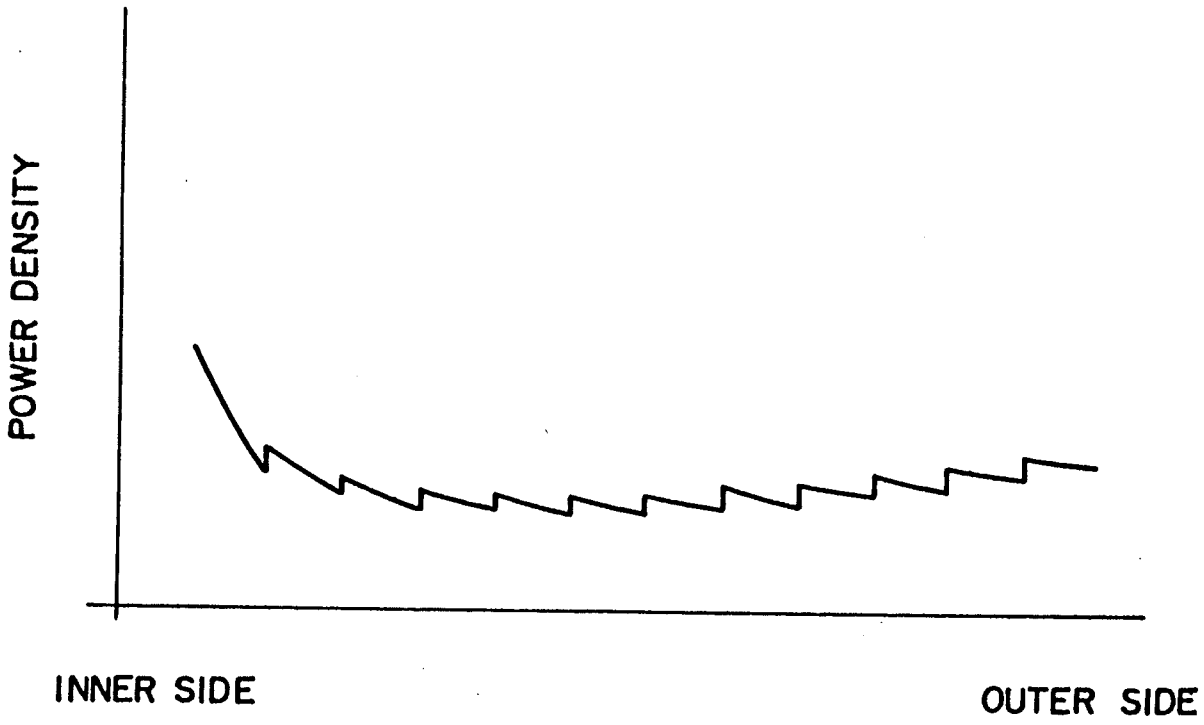
FIG. 29 PRIOR ART
FIG. 29 is a graph showing the power density distribution of the fourth conventional antenna of FIG. 28.
Figure 30:
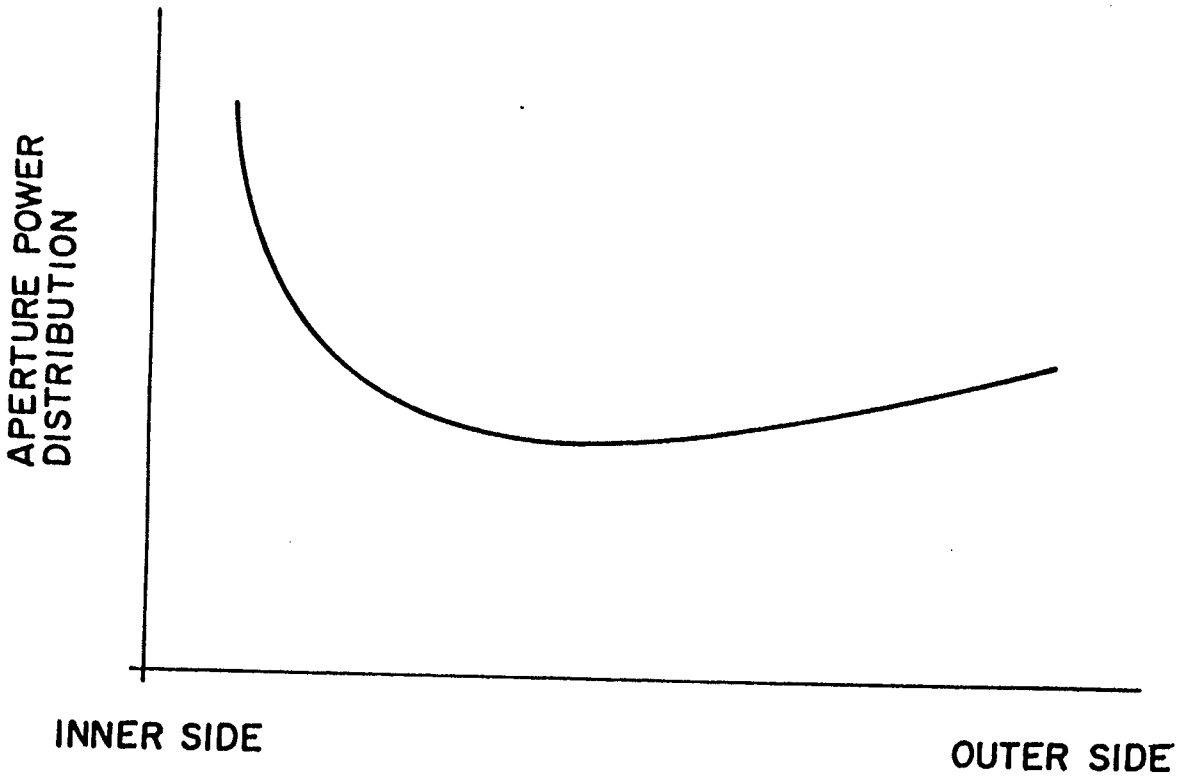
FIG. 30 PRIOR ART
FIG. 30 is a graph showing the power distribution of the antenna of FIG. 28.

The type of antenna shown in FIG. 23 may also be arranged in accordance with the present invention so as to provide a desirable aperture distribution.

Figure 20A:
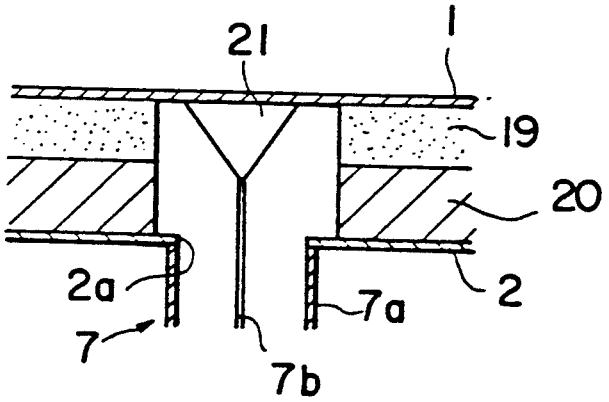
FIGS. 20*a* and 20*b* are sectional views showing eighth and ninth embodiments of the present invention.

FIG. 20a shows the eighth embodiment of the present invention. A circular antenna has a conical matching member 21 made of a metallic material having tapered surfaces disposed at an angle of 45°. The conical matching member 21 is secured to the underside of the plate 1. The apex of the matching member 21 is disposed toward the power feeder opening 2a. The power feeder 7 of the coaxial cable comprises an outer conductor 7a connected to the power feeder opening 2a and an inner conductor 7b connected to the apex of the matching member 21.

Figure 20B:
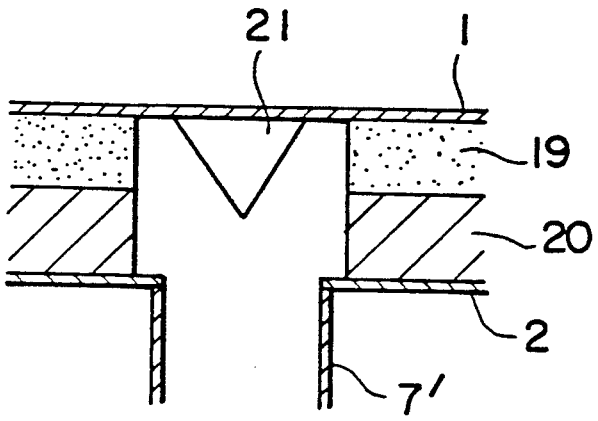

FIG. 20b shows a modification of the antenna of the eighth embodiment and therefore comprises a ninth embodiment of the present invention which is provided with a power feeder waveguide 7' in place of the coaxial cable 7. The matching member 21 is located upon the axis of the feeder waveguide 7' for suppressing the reflection of the power at the power feeder portion.

Figure 20C:
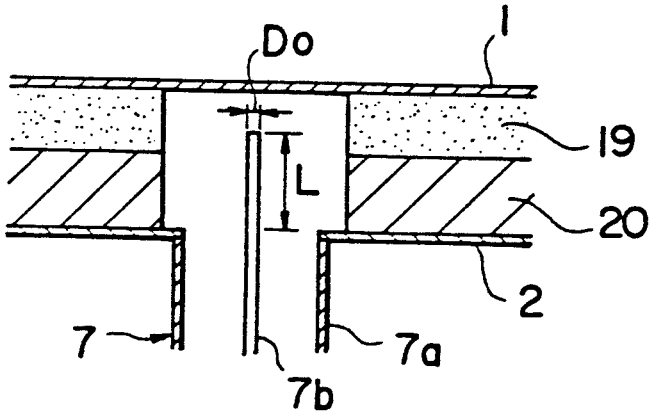
FIG. 20*c* is a sectional view showing a tenth embodiment of the present invention.
Figure 21:
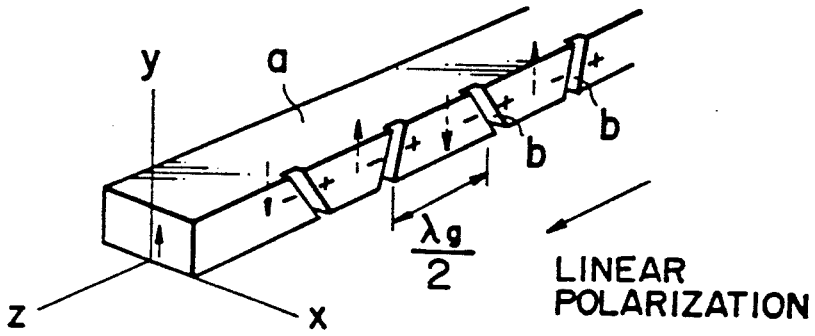
FIG. 21 PRIOR ART
FIG. 21 is a perspective view showing a conventional slot array antenna.
Figure 22:
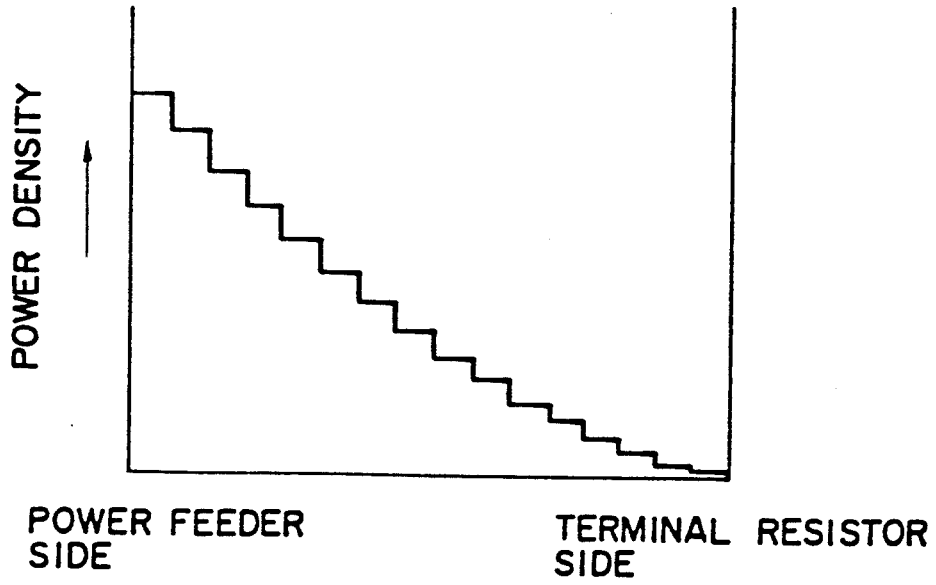
FIG. 22 PRIOR ART
FIG. 22 is a graph showing the power density distribution within the waveguide space of the conventional antenna.

FIG. 20c shows the tenth embodiment of the present invention in which the power feeder 7 of the coaxial cable is used. The matching effect is achieved by adjusting the length L of a probe portion and the diameter Do of the inner conductor 7b. The same effect as that achieved in connection with the eighth embodiment is obtained by means of the tenth embodiment of the present invention.

In accordance with the present invention, the length of each slot and the distance defined between the rows of slots of the antenna are arranged so as to obtain a desired aperture power distribution. Thus, the antenna has the desired characteristics, high efficiency and simple construction.

While the invention has been described in conjunction with preferred specific embodiments thereof, it will be understood that this description is intended to illustrate and not limit the scope of the invention, which is defined by the following claims. The present invention may therefore be practiced, within the scope of the appended claims, otherwise than as specifically described herein.

What is claimed is:

1. A flat slot array antenna, comprising:

a waveguide defined by means of a pair of oppositely disposed spaced metallic plates and a plurality of side plates interconnecting side edges of said spaced metallic plates so as to define a space within said waveguide having a rectangular cross-sectional shape of constant width throughout the length of said waveguide;

power feed opening means defined within one end of said waveguide for feeding power having a predetermined resonant frequency; and a plurality of wave radiation slots defined within one of said metallic plates forming said waveguide wherein when the length of the slot disposed closest to said power feed opening means is larger than a resonant length, the lengths of the remaining slots are progressively reduced such that the slot disposed closest to a terminal end of said waveguide, disposed opposite said power feed opening means, has a resonant length whereby a uniform power distribution is able to be generated from all of said slots, and the distance defined between said slots is progressively increased toward said terminal end of said waveguide so as to compensate for changes in phases of said power distribution generated from said slots due to said progressive reduction of said slot lengths.

2. The antenna according to claim 1 wherein the resonance length is in the vicinity of a one-half wavelength.

3. An antenna as set forth in claim 1, further comprising:

a horn waveguide connected to said rectangular waveguide at said power feed opening.

4. An antenna as set forth in claim 3, further comprising:

a dielectric lens antenna disposed within said horn waveguide.

5. An antenna as set forth in claim 1, further comprising:

a terminal register disposed within said terminal end of said rectangular waveguide.

6. An antenna as set forth in claim 1, further comprising:

a dielectric slow-wave device disposed within said rectangular waveguide space.

7. An antenna as set forth in claim 1, further comprising:

a rectangular feeder waveguide connected to said rectangular waveguide at said power feed opening.

8. An antenna as set forth in claim 1, wherein:

said plurality of wave radiation slots are disposed along a plurality of laterally extending, longitudinally spaced linear loci.

9. A flat slot array antenna, comprising:

a waveguide defined by means of a pair of oppositely disposed spaced metallic plates and a plurality of side plates interconnecting side edges of said spaced metallic plates so as to define a space within said waveguide having a rectangular cross-sectional shape of constant width throughout the length of said waveguide;

power feed opening means defined within one end of said waveguide for feeding power having a predetermined resonant frequency; and a plurality of wave radiation slots defined within one of said metallic plates of said waveguide wherein when the length of the slot disposed closest to said power feed opening means is smaller than a resonant length, the lengths of the remaining slots are progressively increased such that the slot disposed closest to a terminal end of said waveguide, disposed opposite said power feed opening means, has a resonant length whereby a uniform power distribution is able to be generated from all of said slots, and the distances defined between said slots are progressively reduced toward said terminal end of said waveguide so as to compensate for changes in phases of said power distribution generated from said slots due to said progressive increase of said slot lengths.

10. The antenna as set forth in claim 9, wherein:

said resonance length of said slot is within the vicinity of one-half wavelength.

11. An antenna as set forth in claim 9, further comprising:

a horn waveguide connected to said rectangular waveguide at said power feed opening.

12. An antenna as set forth in claim 11, further comprising:

a dielectric lens antenna disposed within said horn waveguide.

13. An antenna as set forth in claim 9, further comprising:

a terminal resistor disposed within said terminal end of said rectangular waveguide.

14. An antenna as set forth in claim 9, further comprising:

a dielectric slow-wave device disposed within said rectangular waveguide space.

15. An antenna as set forth in claim 9, further comprising:

a rectangular feeder waveguide connected to said rectangular waveguide at said power feed opening.

16. An antenna as set forth in claim 9, wherein:

said plurality of wave radiation slots are disposed along a plurality of laterally extending, longitudinally spaced linear loci.

17. A flat slot array antenna, comprising:

a waveguide defined by means of a pair of oppositely disposed, spaced circular metallic plates and an annular side plate interconnecting outer peripheral edge portions of said pair of circular metallic plates so as to define a space within said waveguide having a circular cross-sectional shape;

power feed opening means defined within a central axial portion of one of said circular metallic plates for feeding power having a predetermined resonant frequency; and a plurality of wave radiation slots defined within another one of said circular metallic plates wherein when the length of each slot disposed closest to said power feed opening means at a predetermined radial distance from said power feed opening means is smaller than a resonant length, the lengths of each of said slots disposed at radial distances from said power feed opening means which are greater than said predetermined radial distance are progressively increased such that each of said slots disposed closest to said outer peripheral edge portion of said another one of said circular metallic plates has a resonant length whereby a uniform power distribution is able to be generated from all of said slots, and the radial distances defined between said slots are progressively reduced toward said outer peripheral edge portion of said another one of said circular metallic plates so as to compensate for changes in phases of said power distribution generated from said slots due to said progressive increase of said slot lengths.

18. An antenna as set forth in claim 17, further comprising:

a coaxial cable power feeder means connected to said power feed opening of said one of said circular metallic plates.

19. An antenna as set forth in claim 18, further comprising:

a conical matching member disposed within said circular waveguide space such that said matching member is secured to said another one of said circular metallic plates and is connected to an inner conductor of said coaxial cable power feeder means.

20. An antenna as set forth in claim 17, further comprising:

an intermediate plate disposed within said waveguide space so as to divide said waveguide space into an upper waveguide space and a lower waveguide space.

21. A antenna as set forth in claim 17, wherein:

said plurality of wave radiation slots are disposed along a plurality of radially spaced circular loci.

22. An antenna as set forth in claim 17, further comprising:

slow-wave means disposed within said circular waveguide space.

23. An antenna as set forth in claim 22, wherein said slow-wave means comprises:

a first layer of foam polystyrene; and a second layer of polyethylene.

24. An antenna as set forth in claim 17, further comprising:

a cylindrical power feeder waveguide connected to said power feed opening of said one of said circular metallic plates.

25. An antenna as set forth in claim 24, further comprising:

a conical matching member disposed within said circular waveguide space such that a base portion of said matching member is secured to said another one of said circular metallic plates while a vertex portion of said matching member is disposed coaxially with said cylindrical power feeder waveguide.

26. A flat slot array antenna, comprising:

a waveguide defined by means of a pair of oppositely disposed, spaced circular metallic plates and an annular side plate interconnecting outer peripheral edge portions of said pair of circular metallic plates so as to define a space within said waveguide having a circular cross-sectional shape;

power feed opening means defined within a central axial portion of one of said circular metallic plates for feeding power having a predetermined resonant frequency; and a plurality of wave radiation slots defined within another one of said circular metallic plates wherein when the length of each slot disposed closest to said power feed opening means at a predetermined radial distance from said power feed opening means is greater than a resonant length, the lengths of each of said slots disposed at radial distances from said power feed opening means which are greater than said predetermined radial distance are progressively reduced such that each of said slots disposed closest to said outer peripheral edge portion of said another one of said circular metallic plates has a resonant length whereby a uniform power distribution is able to be generated from all of said slots, and the radial distances defined between said slots are progressively increased toward said outer peripheral edge portion of said another one of said circular metallic plates so as to compensate for changes in phases of said power distribution generated from said slots due to said progressive reduction of said slot lengths.

27. An antenna as set forth in claim 26, further comprising:

a coaxial cable power feeder means connected to said power feed opening of said one of said circular metallic plates.

28. An antenna as set forth in claim 27, further comprising:

a conical matching member disposed within said circular waveguide space such that said matching member is secured to said another one of said circular metallic plates and is connected to an inner conductor of said coaxial cable power feeder means.

29. An antenna as set forth in claim 26, further comprising:

an intermediate plate disposed within said waveguide space so as to divide said waveguide space into an upper waveguide space and a lower waveguide space.

30. An antenna as set forth in claim 26, wherein:

said plurality of wave radiation slots are disposed along a plurality of radially spaced circular loci.

31. An antenna as set forth in claim 26, further comprising:

slow-wave means disposed within said circular waveguide space.

32. An antenna as set forth in claim 31, wherein said slow-wave means comprises:

a first layer of foam polystyrene; and a second layer of polyethylene.

33. An antenna as set forth in claim 21, further comprising:

a cylindrical power feeder waveguide connected to said power feed opening of said one of said circular metallic plates.

34. An antenna as set forth in claim 33, further comprising:

a conical matching member disposed within said circular waveguide space such that a base portion of said matching member is secured to said another one of said circular metallic plates while a vertex portion of said matching member is disposed coaxially with said cylindrical power feeder waveguide.

* * * * *